US006259870B1

(12) United States Patent
Sugimoto

(10) Patent No.: US 6,259,870 B1
(45) Date of Patent: Jul. 10, 2001

(54) FIXING DEVICE CONTROL METHOD AND APPARATUS, FIXING DEVICE, AND IMAGE FORMING MACHINE

(75) Inventor: Katsumi Sugimoto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/580,651

(22) Filed: May 30, 2000

(30) Foreign Application Priority Data

Oct. 15, 1999 (JP) ..... 11-293871

(51) Int. Cl.[7] ..... G03G 15/20
(52) U.S. Cl. ..... 399/69; 219/216; 399/70
(58) Field of Search ..... 399/33, 67, 69, 399/70, 122, 320, 330; 219/216

(56) References Cited

U.S. PATENT DOCUMENTS 5,768,654 * 6/1998 Noguchi et al. ..... 399/69
5,854,957 * 12/1998 Morikawa ..... 399/70 X
5,987,274 * 11/1999 Satoh ..... 399/69

FOREIGN PATENT DOCUMENTS 8248809 9/1996 (JP) .
9096989 4/1997 (JP) .

* cited by examiner

*Primary Examiner*—Arthur T. Grimley
*Assistant Examiner*—Hoan Tran
(74) *Attorney, Agent, or Firm*—Armstrong, Westerman, Hattori, McLeland & Naughton, LLP

(57) ABSTRACT

In a photoelectrographic image forming machine of the power saving type, a temperature rise tendency calculating unit calculates a tendency of temperature rise in terms of an amount of temperature rise per unit time during the normal operation mode, and a temperature calculating unit calculates a lowest temperature of the heating unit during the power saving mode in terms of a temperature such that a duration till the temperature of the heating unit reaches the target fixing temperature is a desired period during which the image forming machine restores the normal operation mode from the power saving mode. A fixing temperature control unit keeps the temperature of a heating unit not less than the lowest temperature during the power saving mode. The result is that the restoration period can be kept not more than the maximum period the user can be patient to wait.

36 Claims, 11 Drawing Sheets

RISE OF FIXING TEMP.

FIXING DEVICE CONTROL METHOD AND APPARATUS, FIXING DEVICE, AND IMAGE FORMING MACHINE

BACKGROUND OF THE INVENTION

1. Field of the Invention

The present invention relates to a fixing device control method and apparatus, a fixing device, and an image forming machine, which are all suitable for use in a photoelectrographic copying or printing machine of the type equipped with a fixing unit in the form of a heat roller or the like and having a power saving function.

2. Description of the Related Art

In recent years an increasing number of image forming machines of the power-saving type have been put on the market which automatically assumes a power saving mode, after the lapse of a predetermined period without performing a image forming operation, to reduce the power consumption. In the meantime demands for such machines whose power consumption during the power saving mode is as small as to meet the criteria, such as, Energy Star™ are on the rise.

Generally in a photoelectrographic image forming machine, a fixing device consumes a great amount of electric power to heat toner of the image formed on printing paper into a molten form to fix it onto the paper. Consequently it is particularly effective to decrease power consumption of the fixing device itself during the power saving mode, which would result in reduced power consumption of the whole image forming machine during that mode.

In many of image forming machines of this type, the fixing device has a heat roller, with a built-in halogen lamp or the like, as a heating unit which melts unfixed toner of the image formed on the printing paper to fix it onto the paper.

In operation, the fixing device turns the halogen lamp on to heat the circumferential surface of the heat roller to a temperature high enough to melt the toner (target fixing temperature: 185° C., for example) and then controls the temperature of the heat roller by turning the halogen lamp on/off.

While measuring the surface temperature of the heat roller using a temperature measuring device such as a thermistor, the fixing device turns the halogen lamp on/off so as to keep the temperature of the heat roller within the range of temperature enabling the fixing.

Specifically, the fixing device turns the halogen lamp on to heat the surface of the heat roller to the target fixing temperature, and then turns the halogen lamp off when the temperature reaches the target temperature. At that time, the surface temperature of the heat roller keeps increasing due to the remaining heat inside the heat roller, which would cause a phenomenon called overshooting: the surface temperature of the heat roller rises over the target fixing temperature.

Accordingly, it is important to appropriately design the heat roller (thickness or material of the roller, etc.) and to set the heat distribution characteristic of the halogen lamp such that the temperature of the heat roller would never exceed the temperature range enabling the printing operation, even if the temperature of the heat roller rises over the target fixing temperature.

After the halogen lamp has been turned off, the surface temperature of the heat roller overshoots the target fixing temperature and then gradually drops. When that temperature drops below the target fixing temperature, the fixing device turns the halogen lamp on again to heat the heat roller once more.

In the meantime, during recent years, printing machines have been used in a variety of environments. In an exemplified environment, a printing machine is coupled to a computer network and shared by the individual computers in the network. In use, the operators of two or more computers click the "start" at the same time to issue respective commands each for execution of a printing operation and such situation would often cause the printing machine to keep on stand-by for the printing operation for a long period.

As a solution, another power-saving printing machine is known in which electric power supplied to the printing machine is reduced during a stand-by mode for printing operation. After standing by a predetermined time without performing a fixing operation during the normal operation mode, a power-saving image forming apparatus of this machine shifts from the normal operation mode to the power saving mode to reduce power consumption. And a fixing device of the apparatus also shifts to the power saving mode accordingly.

Conventional methods for controlling turning on/off of the halogen lamp of the fixing device in the image forming machine during the power saving mode are exemplified by the following:

during the power saving mode, (1) turn the halogen lamp off;

(2) keep the surface temperature of the heat roller around a reference temperature during the power saving mode, which is lower than the target fixing temperature, by turning the halogen lamp off when the current surface temperature of the heat roller is higher than the reference value during the power saving mode (100° C., for example), and then turning the halogen lamp on when the surface temperature of the heat roller is lower than the reference value during the power saving mode; and (3) turn the halogen lamp on at a predetermined electric power.

FIG. 12 of the accompanying drawings shows tendencies of temperature rise of the circumferential surface of the heat roller when the temperature of the heat roller was controlled using four different target temperatures (25° C., 155° C., 160° C., 165° C.). As depicted in FIG. 12, it took a certain amount of period (approximately 100 seconds for each target fixing temperature) to heat the heat roller to the target temperature (target fixing temperature) at which the toner of the image can be melted).

However, none of the conventional control methods (1) through (3) considered a period needed for heating the heat roller to the target fixing temperature when the normal operation mode was restored after the power saving mode. Therefore, when the image forming machine restores the normal operation mode from the power saving mode, the period (restoration period) , during which the heat roller is heated to the target fixing temperature high enough to perform a printing (fixing) operation, would sometimes be longer than the user can be patient to wait thus resulting in less user-friendly products.

Yet, the above conventional control method (2) has another problem that repeatedly turning the halogen lamp on and off causes not only a shortened life of the heater lamp but also a sudden rise of electric current upon every turning on of the heater lamp, which would increase the power consumption.

Still another problem with the conventional control method (2) is that in an attempt to reduce the restoration period, the temperature of the heat roller during the power saving mode would tend to be set to a higher value than necessary, making it impossible to reduce the power consumption during the power saving mode so that only inadequate power saving results can be achieved.

Further, the restoration period depends on the temperature of the heat roller, which would tend to be influenced by the environment where the image forming machine is used, thus making it difficult to control the temperature.

SUMMARY OF THE INVENTION

With the foregoing problems in view, it is an object of the present invention to provide a fixing device control method and apparatus with which the restoration period needed for a fixing device to restore the normal operation mode from power saving mode would never be longer than the user can be patient to wait, without the risk of impairing the power saving function.

Another object of the present invention is to provide a fixing device equipped with the control apparatus described in connection with the first-named object.

Still another object of the invention is to provide an image forming machine equipped with the control apparatus described in connection with the first-named object.

In order to accomplish the above first-named object, according to a first inventive concept of the present invention, there is provided a method of controlling temperature of a heating unit of a fixing device, which shifts from a normal operation mode to a power saving mode after the lapse of a predetermined time without performing a fixing operation during the normal operation mode and restores the normal operation mode upon receipt of a fixing operation request during the power saving mode, to fix a toner image, which is formed on a medium, to the medium as the heating unit heats the toner of the image, the method comprising the steps of: measuring a temperature of the heating unit during the normal operation mode; calculating a first tendency of temperature rise in terms of an amount of temperature rise per unit time when the temperature is controlled so as to rise during the normal operation mode, based on the result of temperature measurement; calculating, based on the first tendency of temperature rise, a lowest temperature of the heating unit during the power saving mode in terms of a temperature such that a duration till the temperature of the heating unit reaches a target fixing temperature enough to melt the toner of the image is a desired period during which the fixing device restores the normal operation mode from the power saving mode; and keeping the temperature of the heating unit not lower than the lowest temperature.

As a preferred feature, the temperature of the heating unit is controlled by intermittently turning on/off a heater lamp in a heat roller, which constitutes the heating unit.

As another preferred feature, a cycle of turning on of the heater lamp during the normal operation mode is calculated, and then during the power saving mode the heater lamp is intermittently turned on/off by a longer cycle than the calculated cycle of turning on.

As still another preferred feature, the lowest temperature of the heating unit is calculated a predetermined time earlier than when the fixing device shifts to the power saving mode. Alternatively the cycle of turning on of the heater lamp may be calculated a predetermined time earlier than when the fixing device shifts to the power saving mode.

As a further preferred feature, during the power saving mode, a second tendency of temperature rise is calculated in terms of an amount of temperature rise per unit time when the temperature of the heating unit is controlled so as to rise, based on the result of temperature measurement. The lowest temperature is recalculated based on the second tendency of temperature rise, and the temperature of the heating unit is kept not lower than the recalculated lowest temperature.

According to a second inventive concept of the present invention, the first-named object is accomplished by an apparatus for controlling temperature of a heating unit of a fixing device, which shifts from a normal operation mode to a power saving mode after the lapse of a predetermined time without performing a fixing operation during the normal operation mode and restores the normal operation mode upon receipt of a fixing operation request during the power saving mode, to fix a toner image, which is formed on a medium, to the medium as the heating unit heats the toner of the image, the apparatus comprising: a temperature measuring unit for measuring a temperature of the heating unit of the fixing device; a fixing temperature control unit for keeping the temperature of the heater unit, during the normal operation mode, at a target fixing temperature enough to melt the toner of the image and, during the power saving mode, lower than the target fixing temperature; a temperature rise tendency calculating unit for calculating a first tendency of temperature rise in terms of an amount of temperature rise per unit time when the temperature of the heating unit is controlled so as to rise during the normal operation mode, based on the result of temperature measurement; and a temperature calculating unit for calculating a lowest temperature of the heating unit during the power saving mode in terms of a temperature such that a duration till the temperature of the heating unit reaches the target fixing temperature is a desired period during which the fixing device restores the normal operation mode from the power saving mode. The fixing temperature control unit is operable to keep the temperature of the heating unit not lower than the lowest temperature during the power saving mode, based on the result of temperature measurement of the temperature measuring unit.

As a preferred feature, the fixing temperature control unit controls the temperature of the heating unit by intermittently turning a heater lamp on/off in a heat roller, which constitutes the heating unit.

As another preferred feature, the apparatus includes a cycle calculating unit for calculating a cycle of turning on of the heater lamp during the normal operation mode. And the fixing temperature control unit turns the heater lamp on during the power saving mode by a longer cycle than that during the normal operation mode.

As still another preferred feature, the temperature calculating unit may calculate the lowest temperature of the heating unit a predetermined time earlier than when the fixing device shifts to the power saving mode. Alternatively the cycle calculating unit may calculate the cycle of turning on of the heater lamp a predetermined time earlier than when the fixing device shifts to the power saving mode.

As a further preferred feature, during the power saving mode, the temperature rise tendency calculating unit calculates a second tendency of temperature rise in terms of an amount of temperature rise per unit time when the temperature of the heating unit is controlled so as to rise, based on the result of temperature measurement. The temperature calculating unit may recalculate the lowest temperature based on the second tendency of temperature rise, and then the fixing temperature control unit keeps the temperature of the heating unit not lower than the recalculated lowest temperature based on the result of temperature measurement.

According to a third inventive concept of the present invention, the second-named object is accomplished by a fixing device, which shifts from a normal fixing mode to a power saving mode after the lapse of a predetermined time without performing a fixing operation during the normal fixing mode and restores the normal operation mode upon receipt of a fixing operation request during the power saving mode, for fixing a toner image formed on a medium, the device comprising a heating unit for heating the toner of the image into a molten form to cause the molten form to adhere to the medium; a temperature measuring unit for measuring a temperature of the heating unit; a fixing temperature control unit for keeping the temperature of the heating unit, during the normal operation mode, at a target fixing temperature and, during the power saving mode, lower than the target fixing temperature; a temperature rise tendency calculating unit for calculating a first tendency of temperature rise in terms of an amount of temperature rise per unit time when the temperature of the heating unit is controlled so as to rise during the normal operation mode, based on the result of temperature measurement; and a temperature calculating unit for calculating a lowest temperature of the heating unit during the power saving mode in terms of a temperature such that a duration till the temperature of the heating unit reaches the target fixing temperature is a desired period during which the fixing device restores the normal operation mode from the power saving mode. The fixing temperature control unit is operable to keep the temperature of the heating unit not lower than the lowest temperature during the power saving mode, based on the result of temperature measurement of the temperature measuring unit.

As a preferred feature, the heating unit includes a heat roller having a built-in heater lamp that is to be turned on/off by the fixing temperature control unit for keeping the temperature of the heating unit.

As another preferred feature, the fixing device further comprises a cycle calculating unit for calculating a cycle of turning on of the heater lamp during the normal operation mode. And the fixing temperature control unit is operable to turn the heater lamp on by a longer cycle than the above-mentioned cycle of turning on during the power saving mode.

As still another preferred feature, the temperature calculating unit calculates the lowest temperature of the heating unit a predetermined time earlier than when the fixing device shifts to the power saving mode. Alternatively the cycle calculating unit may calculate the cycle of turning on of the heater lamp a predetermined time earlier than when the fixing device shifts to the power saving mode.

As a further preferred feature, during the power saving mode, the temperature rise tendency calculating unit calculates a second tendency of temperature rise in terms of an amount of temperature rise per unit time when the temperature of the heating unit is controlled so as to rise, based on the result of temperature measurement. And the temperature calculating unit recalculates the lowest temperature based on the second tendency of temperature rise, and then the fixing temperature control unit keeps the temperature of the heating unit not lower than the recalculated lowest temperature based on the result of temperature measurement.

According to a fourth inventive concept of the present invention, the third-named object is accomplished by an image forming machine, which is controlled so as to shift from a normal operating mode to a power saving mode after the lapse of a predetermined time without performing an image forming operation during the normal operation mode and to restore the normal operation mode upon receipt of an image forming operation request during the power saving mode, the machine comprising an image supporting unit on which a latent image is to be formed based on given image information; a developing unit for bringing the latent image to a visible image using toner; a transferring unit for transferring the developed image on the image supporting unit to a medium; a fixing device having a heating unit for heating the toner of the image, which is transferred to the medium, to fix the toner image to the medium; a temperature measuring unit for measuring a temperature of the heating unit of the fixing device; a fixing temperature control unit for keeping the temperature of the heater unit, during the normal operation mode, at a target fixing temperature enough to melt the toner of the image and, during the power saving mode, lower than the target fixing temperature; a temperature rise tendency calculating unit for calculating a first tendency of temperature rise in terms of an amount of temperature rise per unit time when the temperature of the heating unit is controlled so as to rise during the normal operation mode, based on the result of temperature measurement; and a temperature calculating unit for calculating a lowest temperature of the heating unit during the power saving mode in terms of a temperature such that a duration till the temperature of the heating unit reaches the target fixing temperature is a desired period during which the image forming machine restores the normal operation mode from the power saving mode. The fixing temperature control unit is operable to keep the temperature of the heating unit not lower than the lowest temperature during the power saving mode, based on the result of temperature measurement of the temperature measuring unit.

As a preferred feature, the heating unit includes a heat roller having a built-in heater lamp. And the fixing temperature control unit is operable to control the temperature of the heating unit by intermittently turning the heater lamp on/off.

As another preferred feature, the image forming machine further comprises a cycle calculating unit for calculating a cycle of turning on of the heater lamp during the normal operation mode. And the fixing temperature control unit is operable to turn the heater lamp on by a longer cycle than the above-mentioned cycle of turning on during the power saving mode.

As still another preferred feature, the temperature calculating unit calculates the lowest temperature of the heating unit a predetermined time earlier than when the fixing device shifts to the power saving mode. Alternatively the cycle calculating unit may calculate the cycle of turning on of the heater lamp a predetermined time earlier than when the fixing device shifts to the power saving mode.

As a further preferred feature, during the power saving mode, the temperature rise tendency calculating unit calculates a second tendency of temperature rise in terms of an amount of temperature rise per unit time when the temperature of the heating unit is controlled so as to rise, based on the result of temperature measurement. And the temperature calculating unit recalculates the lowest temperature based on the second tendency of temperature rise, and then the fixing temperature control unit keeps the temperature of the heating unit not lower than the recalculated lowest temperature based on the result of temperature measurement.

As an additional feature, the image forming machine further comprises a time input unit for setting/inputting an arbitrary time as the desired time during which the image forming machine restores the normal operation mode from the power saving mode.

With the foregoing features of the fixing device control method and apparatus, a fixing device, and an image forming machine, it is possible to guarantee the following advantageous results:

(1) It is possible that the fixing device restores the normal operation mode from the power saving mode within a desired restoration period, without the risk of impairing the power saving function. Therefore the restoration period would never be longer than the user can be patient to wait, thus resulting in user-friendly products.

(2) Since the temperature of the heating unit is controlled by intermittently turning a built-in heater lamp in a heat roller on/off, which constitutes the heating unit, it is possible to surely control the temperature of the heating unit, thus improving the reliability of the image forming machine.

(3) Partly since the cycle of turning on of the heater lamp during the normal operation mode is calculated and partly since, during the power saving mode, the heater lamp is intermittently turned on/off by a longer cycle than the calculated cycle of turning on, it is possible to decrease the frequency of turning on/off of the heater lamp during the power saving mode, thus extending the life of the heater lamp and reducing the power consumption due to a sudden rise of electric current upon turning on of the heater lamp.

(4) Since the lowest temperature of the heating unit is calculated a predetermined time earlier than when the fixing device shifts to the power saving mode, it is possible to keep the influence of environment to a minimum. Thus the fixing device can restore the normal operation mode from the power saving mode within a desired period, irrespective of the environment of installation. Consequently, the restoration period would never be longer than the user can be patient to wait, thus resulting in user-friendly products.

(5) Since the cycle of turning on of the heater lamp is calculated a predetermined time earlier than when the fixing device shifts to the power saving mode, it is possible to keep the influence of environment of installation to a minimum and also to surely reduce the frequency of turning on/off of the heater lamp during the power saving mode lower than that during the normal operation mode, thus extending the life of the heater lamp and reducing the power consumption due to an sudden rise of electric current upon turning on of the heater lamp.

(6) Partly since during the power saving mode, a second tendency of temperature rise may be calculated in terms of an amount of temperature rise per unit time when the temperature of the heating unit is controlled so as to rise, based on the result of temperature measurement; the lowest temperature may be recalculated based on the second tendency of temperature rise; and partly since the temperature of the heating unit may be kept not lower than the recalculated lowest temperature, it is possible to calculate the temperature rise tendency and the lowest temperature accurately, thus improving the reliability of the image forming machine.

(7) Since the image forming machine further includes a time input unit for setting/inputting an arbitrary time as the desired time during which the image forming machine restores the normal operation mode from the power saving mode, the user can set or input a desired period for restoring the normal operation mode, thus making the machine user-friendly.

DESCRIPTION OF THE PREFERRED EMBODIMENT(S)

One embodiment of the present invention will now be described with reference to the accompanying drawings.

Figure 1:
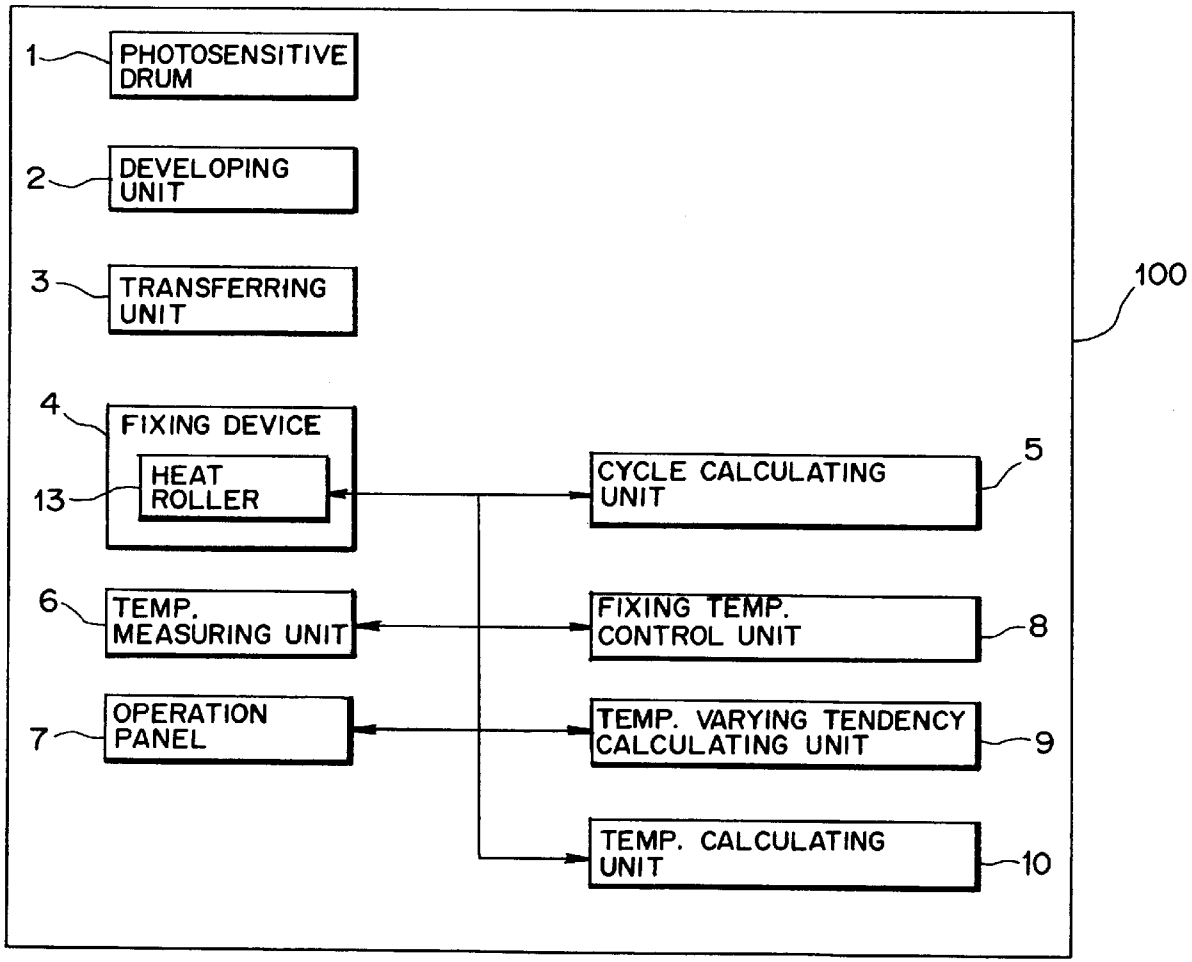
FIG. 1 is a block diagram schematically showing an image forming machine according to an embodiment of the present invention.
Figure 2:
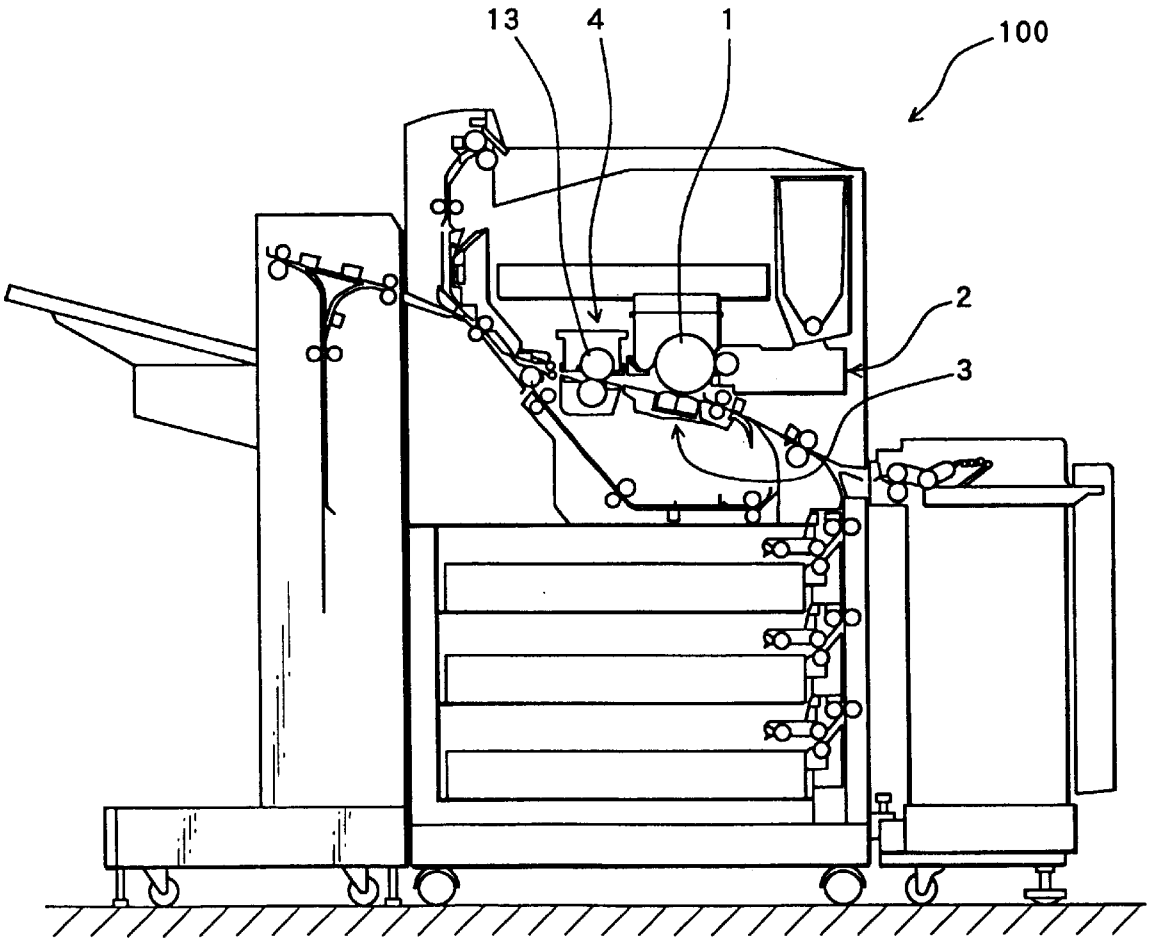
FIG. 2 is a side view, with parts broken away, of the image forming machine of the present embodiment.
Figure 3:
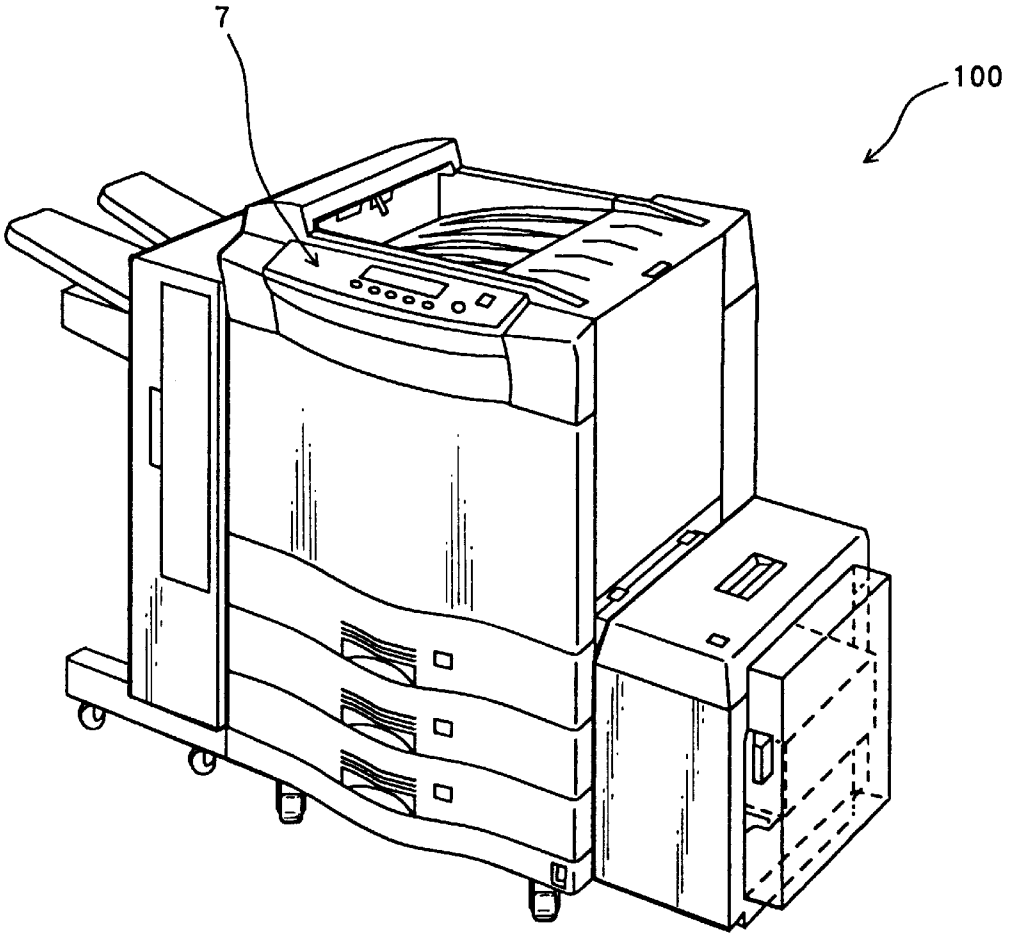
FIG. 3 is a perspective view showing the appearance of the image forming machine of the present embodiment.
Figure 4:
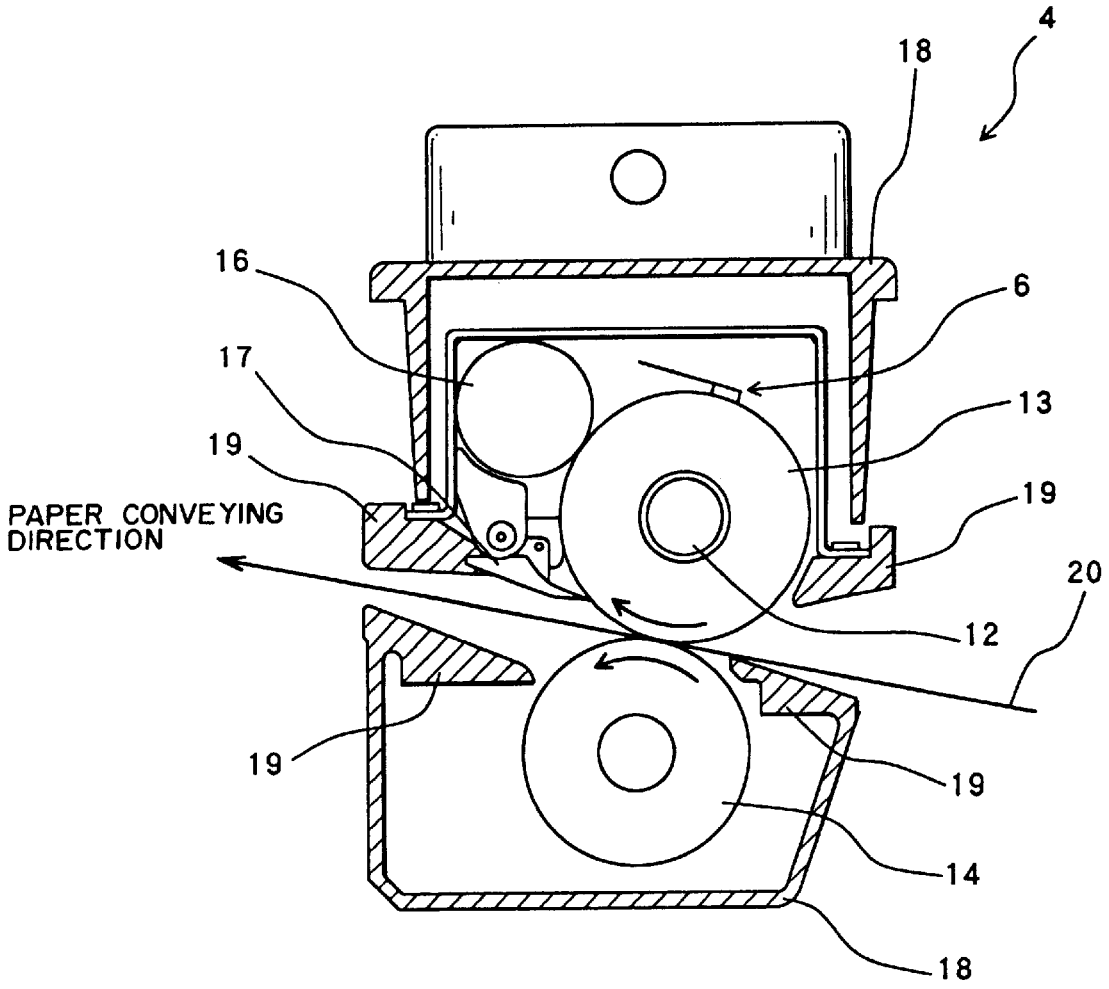
FIG. 4 is an enlarged, cross-sectional view showing a fixing device of the image forming machine of FIGS. 2 and 3.
Figure 5:
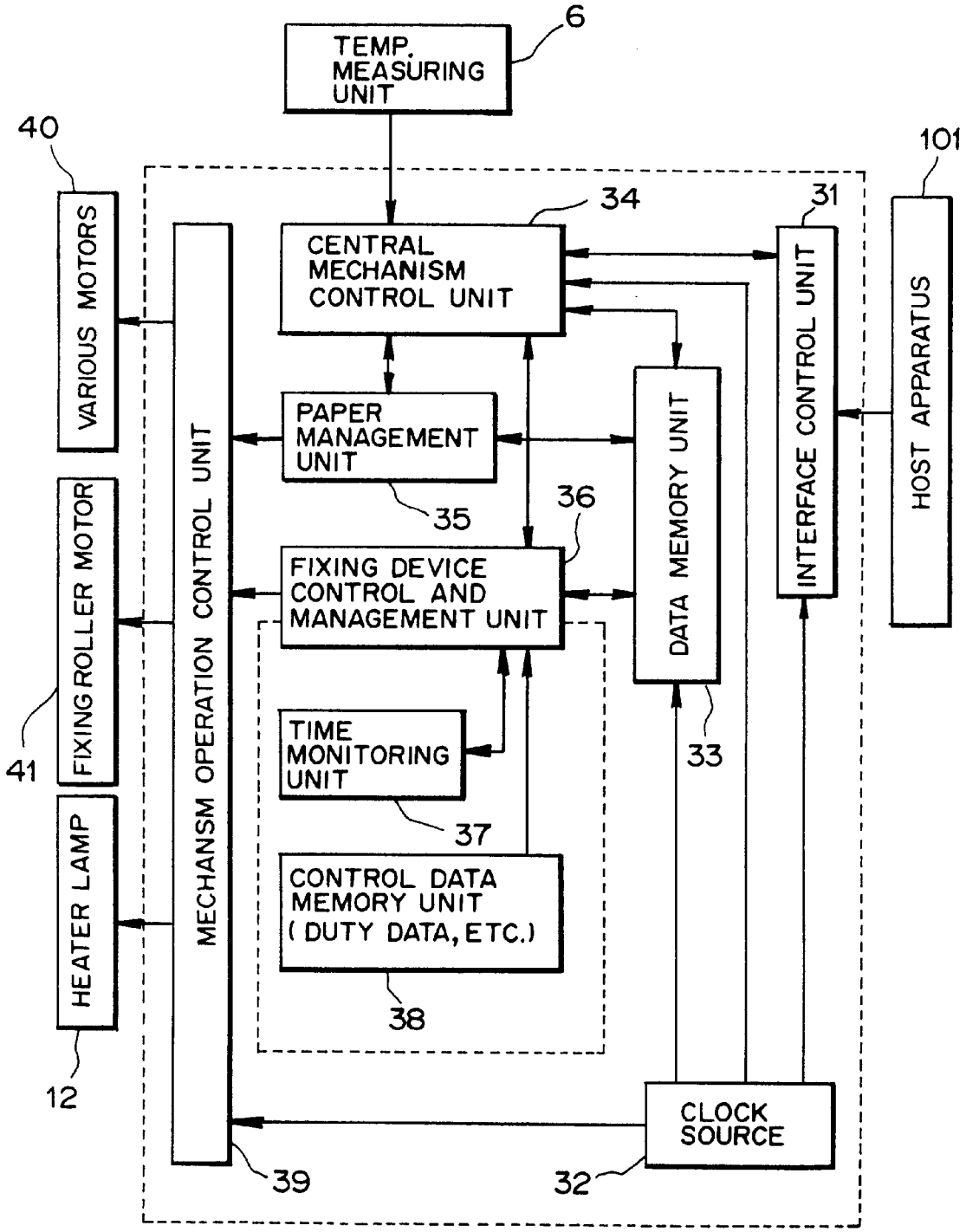
FIG. 5 is a block diagram schematically showing a control system of the image forming machine of the present embodiment.
Figure 6:
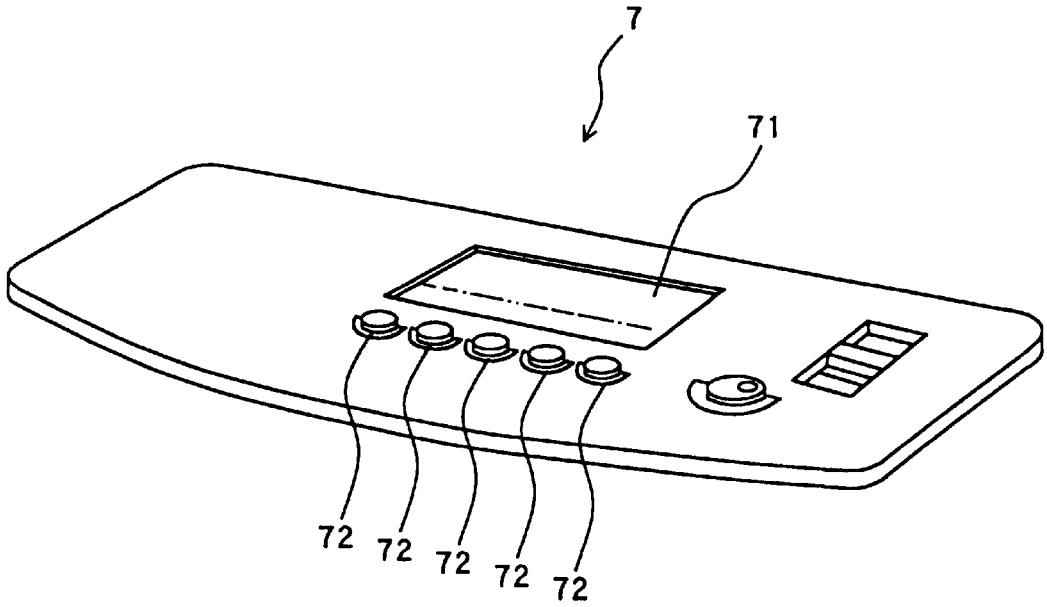
FIG. 6 is a perspective view of an operation panel of the image forming machine of the present embodiment.
Figure 7:
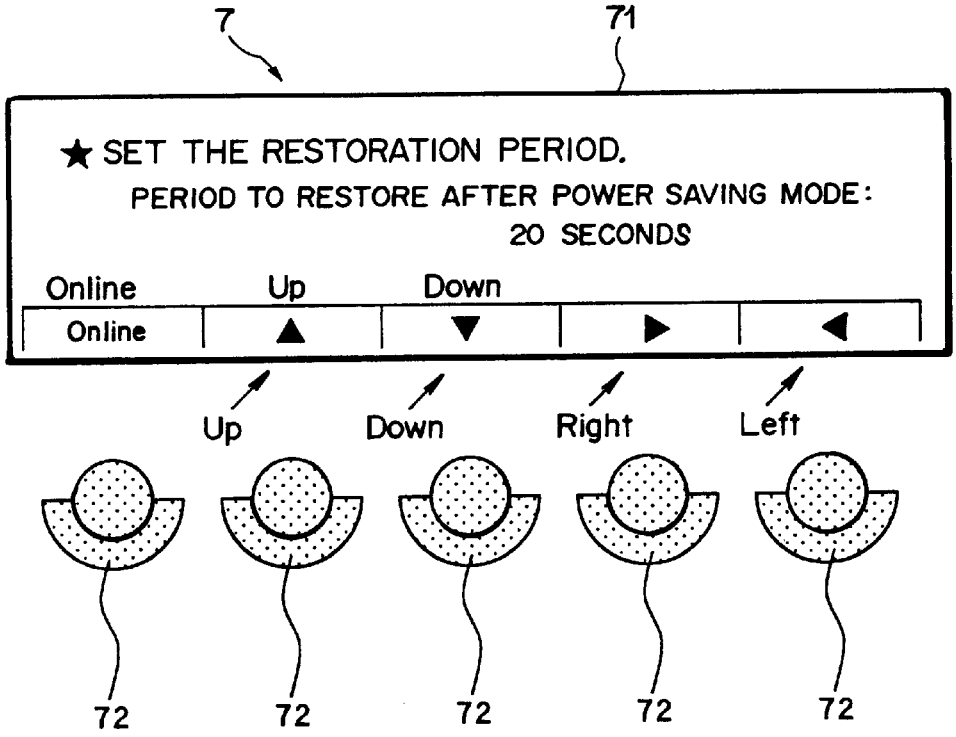
FIG. 7 is a fragmentary, enlarged top plan view of the operation panel of FIG. 6.

FIG. 1 is a block diagram schematically showing an image forming machine (hereinafter also called the machine) embodying the present invention; FIG. 2 is a side view, with parts broken away, of the machine; FIG. 3 is a perspective view of the machine, FIG. 4 is an enlarged cross-sectional view showing a fixing device of the machine; FIG. 5 is a block diagram schematically showing a control system of the machine; and FIGS. 6 and 7 are a perspective view and an enlarged top plan view, respectively, of an operation panel of the machine.

The image forming machine 100 (FIGS. 1 to 3 and 5) is responsive to image data or commands from a host machine (host apparatus) 101 (FIG. 5), such as a host computer, to form an image on a medium such as printing paper 20 (FIG. 4). The machine 100 shifts from a normal operation mode to a power saving mode in which power consumption is reduced.

If the power saving mode has been set effective in advance, the image forming machine 100 shifts from the normal operation mode to the power saving mode after the lapse of a predetermined time (Y minutes in the present embodiment) without performing an image forming operation during the normal operation mode. And upon receipt of an image forming operation request during the power saving mode, the machine 100 restores the normal operation mode.

The image forming machine 100 comprises, as shown in FIGS. 1 and 2, a photosensitive drum (image supporting unit) 1, a developing unit 2, a transferring unit 3, a fixing device 4, a cycle calculating unit 5, a temperature measuring unit 6, an operation panel (time input section) 7, a fixing temperature control unit 8, a temperature varying tendency calculating unit (temperature rise tendency calculating unit) 9, and a temperature calculating unit 10. The machine 100 further comprises non-illustrated various other parts or elements, such as an AC discharging device, a cleaning unit, and an LED (light emitting diode) discharging device.

On the circumferential surface of the photosensitive drum 1, a latent image is formed based on given image information. After a preliminary electric charger (not shown) charges uniformly the drum surface, parts of the resultant drum surface is exposed to light from an exposure LED (not shown) or the like in accordance with an image of the document to be copied. The drum is driven by a drive motor (not shown) to rotate in a direction that printing paper (medium) 20 is conveyed to form a toner image on the drum surface.

The developing unit 2 develops the latent image, formed on the surface of the photosensitive drum 1, into a visible image using toner.

The transferring unit 3 transfers the toner image, formed on the photosensitive drum 1, onto the printing paper 20. Where the drum 1 and the printing paper 20 come into contact with each other, the transferring unit 3 charges the printing paper 20 by producing a corona discharge at an electrical potential of which polarity is opposite to that of the toner image so that the toner of the image is attracted/transferred to the printing paper 20.

Further, the transferring unit 3 has a non-illustrated separation-dedicated charger, which charges the printing paper 20 so that an electrical potential of the printing paper 20 after the toner image being transferred is canceled or discharged; since then the printing paper 20 can be separated off the photosensitive drum 20 with ease as the paper 20 travels in the paper conveying path.

A portion of the circumferential surface of the photosensitive drum 1, which portion has passed a transferring station where the toner image is transferred to the printing paper 20, revolves through the cleaning unit, by which the residual toner on the drum surface is removed.

The fixing device 4 heats the toner of the image, which has been transferred onto the printing paper 20, into a molten form so that the toner can adhere to the paper 20. As shown in FIG. 4, the fixing device 4 includes a heat roller (hereinafter also called the heating unit) 13, a backup roller 14, an oil felt roller 16, a separation pawl 17, and a cover 18.

The heat roller 13 is made of a material high in conductivity and in heat resistance, extending perpendicularly (transversely) to the paper conveying path. The heat roller 13 has a heater lamp 12, such as a halogen lamp, mounted along the axis of the heat roller 13.

A temperature of the heat roller 13 is raised by turning the heater lamp 12 on. During the normal operation mode, the temperature of the circumferential surface of the heat roller 13 is raised to not less than a target temperature (target fixing temperature) enough to melt the toner.

In other words, the heat roller 13 functions as a heating unit heating the toner of the image that has been transferred onto the printing paper 20 in order to fix the toner image to the printing paper 20. The toner image transferred to the printing paper 20 is then heated into a molten form to adhere to the paper 20.

Further, the temperature measuring unit 6, in the form of a thermistor, for example, is disposed in contact with the circumferential surface of the heat roller 13 for measuring the current temperature of the heat roller 13.

The heater lamp 12 of the heat roller 13 is turned on/off under control of the fixing temperature control unit 8, which is described later.

The backup roller 14 and the heat roller 13 are located one on each side of the printing paper 20, being rotatable in mutually reverse directions.

Moreover, a fixing roller motor 41 (FIG. 5) is operatively connected to the heat roller 13 and/or the backup roller 14. With the paper 20 being sandwiched between the two coactive rollers 13, 14, the fixing roller motor 41 drives the heat roller 13 (or backup roller 14) for rotation in a direction of arrow a in FIG. 4 such that the printing paper 20 is conveyed to the downstream side (left side in FIG. 4), thus bringing the paper 20, along with the toner image fixed thereto, toward the downstream side.

About the circumferential surface of the heat roller 13 and downstream of the position where the heat roller 13 and the backup roller 14 comes into contact, the separation pawl 17 is located so as to touch the circumferential surface of the heat roller 13. After completion of the fixing operation, the separation pawl 17 forcibly takes the printing paper 20 off the heat roller 13 so that the paper 20 is prevented from being caught in the heat roller 13.

Also about the circumferential surface of the heat roller 13 and downstream of the separation pawl 17, the oil felt roller 16 is located touching and in parallel with the heat roller 13, and is rotatable with rotation of the heat roller 13. The oil felt roller 16 applies a clear and colorless oil of high heat resistance to the surface of the heat roller 13 so that the printing paper 20 is prevented from sticking to the heat roller 13.

The fixing device 4 is concealed by the cover 18, which extends in opposite directions so as to wrap the fixing device 4 and terminates in a pair of inwardly directed guide end portions 19.

The operation panel 7 includes, as shown in FIGS. 6 and 7, a display unit 71 and an input unit 72, via which various input operations can be performed, thus enabling the setting of a power saving mode (described later), for example.

With the power saving mode having been set, the operation panel 7 functions as a time input unit, through which a desired time period is input/set as a duration for the machine to restore the normal operation mode from the power saving mode. Accordingly this desired duration is sometimes called a desired restoration period.

The temperature measuring unit 6 measures a temperature of the heat roller 13 at regular intervals (every 10 milliseconds, for example). The temperature of the heat roller 13 measured by the temperature measuring unit 6 is sent to the cycle calculating unit 5, the fixing temperature control unit 8, the temperature varying tendency calculating unit 9, etc.

The cycle calculating unit 5 calculates a cycle of turning on of the heater lamp 12 during a normal operation mode, based on, for example, the intervals of turning on/off of the heater lamp 12, which are controlled by the fixing temperature control unit 8 described later, and the result of measuring the temperature of the heat roller 13 by the temperature measuring unit 6.

The cycle calculating unit 5 calculates the cycle of turning on of the heater lamp 12 a predetermined time (Z minutes) earlier than when the fixing device shifts to the power saving mode (when Y minutes lapses on standby for image forming), namely, when X (=Y−Z) minutes lapses on standby for image forming.

The temperature varying tendency calculating unit 9 calculates a tendency of temperature rise in terms of an amount of temperature rise per unit time when the temperature of the heating unit 13 is controlled so as to rise during a normal operation mode, based on the result of temperature measurement by the temperature measuring unit 6.

Specifically, the temperature varying tendency calculating unit 9 monitors the current temperature of the heat roller 13, which is measured at regular intervals (e.g., every 10 milliseconds) by the temperature measuring unit 6. When the measured temperature of the heat roller 13 is found to be higher than the last measurement result, it is decided that the temperature is increasing. On the contrary, when the measured temperature of the heat roller 13 is found to be lower than the last measurement result, it is decided that the temperature is decreasing.

Taking temperature A1 at time T1 and temperature A2 at time T2 during the tendency of temperature rise being found, the temperature varying tendency calculating unit 9 calculates the tendency of temperature rise in terms of an amount of temperature rise per unit time, (A2−A1)/(T2−T1), when the temperature of the heating unit 13 is controlled so as to rise.

Similarly, taking temperature A3 at time T3 and temperature A4 at time T4 during the tendency of temperature fall being found, the temperature varying tendency calculating unit 9 calculates the tendency of temperature fall in terms of an amount of temperature fall per unit time, (A4−A3)/(T4−T3), when the temperature of the heating unit 13 is controlled so as to fall.

Further, even during the power saving mode, the temperature varying tendency calculating unit 9 calculates at predetermined intervals (e.g., every two hours) the tendency of temperature rise in terms of an amount of temperature rise per unit time when the temperature of the heating unit 13 is controlled so as to rise.

The temperature calculating unit 10 obtains the desired restoration period, which has been input from the operation panel 7, and then calculates, based on the tendency of temperature rise measured by the temperature varying tendency calculating unit 9, a lowest temperature of the heating unit during the power saving mode in terms of a temperature such that a duration till the temperature of the heating unit reaches the target fixing temperature is a desired restoration period.

Specifically, the temperature calculating unit 10 calculates an amount of temperature rise(=the tendency of temperature rise×the desired restoration period), which will be generated based on the measured tendency of temperature rise during the desired restoration period, and then subtracts the calculated amount from the target fixing temperature to obtain the lowest temperature of the heat roller 13.

At that time, the temperature calculating unit 10 calculates a lowest temperature of the heater lamp 12 a predetermined time (Z minutes) earlier (at the time when X (=Y−Z) minutes has lapsed on standby for image forming) than when the image forming machine 100 shifts to the power saving mode (at the time when Y minutes has lapsed on standby for image forming).

Moreover, the image forming machine 100 has a standard period preset as the desired restoration period (default value as of 5 minutes). When the operator does not input the desired restoration period from the operation panel 7, the preset value is used to calculate the lowest temperature of the heat roller 13.

The fixing temperature control unit 8 controls turning on/off of the heater lamp 12 in the heat roller 13 and also controls a voltage used in turning the heater lamp 12 on so as to control the temperature of the heat roller 13 based on the result of temperature measurement by the temperature measuring unit 6.

During the normal operation mode, the fixing temperature control unit 8 controls the temperature of the heat roller 13 so as to maintain the target fixing temperature (e.g., 185° C.). Specifically, when the temperature of the heat roller 13 is higher than the target fixing temperature, the heater lamp 12 is turned off and meanwhile when the temperature of the heat roller 13 is lower than the target fixing temperature, the heater lamp 12 is turned on, thus keeping the temperature of the heat roller 13 within a range of the target fixing temperature ±10° C. (e.g., 175° C. to 195° C.).

During the power saving mode, the fixing temperature control unit 8 controls turning on/off of the heater lamp 12 such that the temperature of the heat roller 13 is lower than the target fixing temperature. And also the fixing temperature control unit 8 controls turning on/off of the heater lamp 12 by a cycle longer than that during the normal operation mode, thus reducing the power consumption of the fixing device 4.

When reducing the temperature of the heat roller 13 by turning the heater lamp 12 off, the fixing temperature control unit 8 turns the heater lamp 12 on at a timing such that the temperature of the heat roller 13 is kept not less than the lowest temperature calculated by the temperature calculating unit 10 in view of the tendency of temperature fall calculated by the temperature varying tendency calculating unit 9.

At that time, the temperature calculating unit 10 recalculates the lowest temperature of the heat roller 13 at regular intervals of a predetermined period (e.g., every two hours), even after the machine 100 shifts to the power saving mode. The fixing temperature control unit 8 controls the heat roller 13 based on the result of measurement by the temperature measuring unit 6 such that the temperature of the heat roller 13 is kept not less than the lowest temperature recalculated by the temperature calculating unit 10.

A control system of the image forming machine 100 of the present embodiment comprises, as shown in FIG. 5, an interface control unit 31, a clock source 32, a data memory unit 33, a central mechanism control unit 34, a paper managing unit 35, a fixing device control and management unit 36, a time monitoring unit 37, a control data memory unit 38, and a mechanism operation control unit 39, for controlling the respective operations of the heater lamp 12, various motors 40, and the fixing roller motor 41 in accordance with the result of measurement by the temperature measuring unit 6 and in accordance with commands from a host apparatus 101.

The interface control unit 31 controls a non-illustrated interface coupling the image forming machine 100 with the host apparatus 101 in order to receive/transmit the image data or control commands from/to the host apparatus 101.

The clock source 32 oscillates regular pulses (clock signals) to supply them to the interface control unit 31, the data memory unit 33, and the mechanism operation control unit 39 so that these units can operate in synchronization with one another.

The data memory unit 33 stores various data, and the central mechanism control unit 34 manages the control system of the image forming machine 100 in an integrated manner.

Information about measured temperature of the heat roller 13 is transmitted from the temperature measuring unit 6 to the central mechanism control unit 34, which controls the fixing device control and management unit 36 based on the information. And the image data and control commands from the host apparatus 101 via the interface control unit 31 are inputted to the central mechanism control unit 34 which controls the various units based on the inputted data and commands.

The paper management unit 35 manages the printing paper 20, i.e., the size and type of the paper 20 and the amount of the remaining paper.

The fixing device control and management unit 36 manages the control of the fixing device 4, controlling the fixing device 4 so as to operate selectively in the power saving mode or in the normal operation mode. The fixing device control and management unit 36 has the respective functions of the cycle calculating unit 5, the fixing temperature control unit 8, the temperature varying tendency calculating unit 9, and the temperature calculating unit 10, as described above.

The time monitoring unit 37 monitors various kinds of time information on the fixing device 4; for example, it monitors a time period lapsed without performing a fixing operation during the normal operation mode and then transmits the result of monitoring to the fixing device control and management unit 36.

The control data memory unit 38 stores various control data, such as duty data, of the fixing device 4.

The mechanism control unit 39 practically controls the respective operations of various mechanisms, such as the fixing roller motor 41, the various motors 40, and the heater lamp 12, of the image forming machine 100 in response to the instructions from the paper management unit 35 and the fixing device control and management unit 36.

With this construction, when the image forming machine 100 forms an image on the printing paper 20 during the normal operation mode, the circumferential surface of the heat roller 13 of the fixing device 4 is heated to the target fixing temperature by turning on the heater lamp 12 of the heat roller 13 before the printing paper 20 onto which a toner image has been transferred by the transferring unit 3 is conveyed to the fixing device 4 by a non-illustrated conveying system.

Then, between the heat roller 13 and the backup roller 14, the unfixed toner of the image formed on the printing paper 20 is heated into a molten form by the heat roller 13, being thereby fixed onto the paper 20.

After the lapse of a predetermined period (Y minutes in this embodiment) without performing an image forming operation during the normal operation mode, the machine 100 shifts to the power saving mode, in response to which the fixing device 4 also shifts to the power saving mode.

Figure 8:
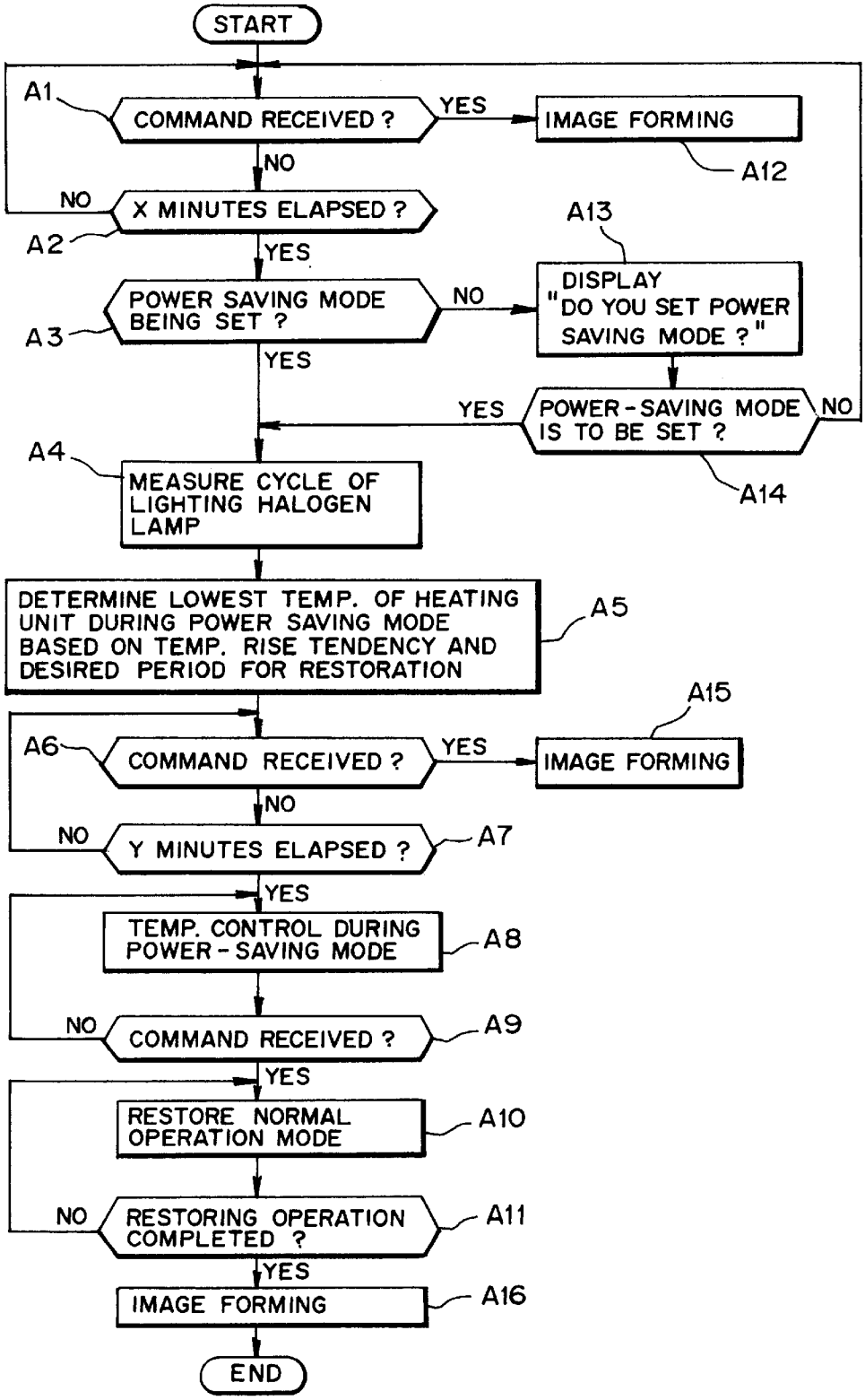
FIG. 8 is a flowchart illustrating the manner in which the image forming machine of the present embodiment operates when shifting from the normal operation mode to the power saving mode.

The procedure in which the mode is shifted from the normal operation mode to the power saving mode will now be described with reference to the flowchart (steps A1 through A16) of FIG. 8.

First of all, during the normal operation mode, the image forming machine 100 discriminates whether a command to perform image forming has been received from the host apparatus 101 (step A1). If the command has been received (YES route of step A1), the image forming machine 100 performs the image forming operation (step A12). If the command has not been received (NO route of step A1), the image forming machine 100 then discriminates whether X minutes (a predetermined time) has lapsed without performing a image forming operation during the normal operation mode (step A2).

At that time, if X minutes has not yet lapsed (NO route of step A2), the procedure returns to step A1. On the contrary, if X minutes has lapsed (YES route of step A2), the machine 100 then discriminates whether the power saving mode has been set (step A3).

If the power saving mode has not been set (NO route of step A3), a massage asking if the power saving mode should be set is displayed on the display unit 71 of the operation panel 7 (step A13) for the operator's decision (step A14). If the power saving mode should not be set at this step (NO route of step A14), the procedure returns to step A1.

If the power saving mode should be set (YES route of step A14) or if the power saving mode has already been set (YES route of step A3), the cycle calculating unit 5 calculates the cycle of turning on of the heater lamp 12 during the normal operation mode, based on the intervals of turning on/off of the heater lamp 12 controlled by the fixing temperature control unit 8 (step A4). How to set the power saving mode will be described later.

After that, utilizing the desired restoration period input from the operation panel 7 and the tendency of temperature rise calculated by the temperature varying tendency calculating unit 9, the temperature calculating unit 10 calculates the lowest temperature of the heat roller 13 during the power saving mode in terms of the temperature such that the duration till the temperature of the heat roller 13 reaches the target fixing temperature equals to the desired restoration period (step A5) How to calculate the tendencies of temperature rise and fall and the lowest temperature of the heat roller 13 will be described later.

The image forming machine 100 then discriminates whether the image forming command has been received from the host apparatus 101 (step A6) If the command has been received (YES route of step A6), the image forming machine 100 performs an image forming operation (step A15). Otherwise, if the command has not been received (NO route of step A6) the image forming machine 100 then discriminates whether Y minutes (a predetermined time) has lapsed without performing an image forming operation during the normal operation mode (step A7).

If Y minutes has not yet lapsed (NO route of step A7), the step A6 is repeated once again, waiting for the lapse of Y minutes. If Y minutes lapsed (YES route of step A7), the machine 100 controls the fixing device 4 under the power saving mode (step A8); in a way that the fixing temperature control unit 8 turns the heater lamp 12 on/off, by a longer cycle than that during the normal operation mode, to keep the temperature of the heat roller 13 lower than the target fixing temperature, Next, the image forming machine 100 discriminates whether the image forming command has been received from the host apparatus 101 (step A9). If the command has not been received (NO route of step A9), the procedure returns to step A8 so that the machine 100 keeps on stand-by in the power saving mode till the command of image forming is received from the host apparatus 101.

If the image forming command has been received (YES route of step A9), the machine 100 begins to restore the normal operation mode (step A10) and discriminates whether the heat roller 13 has been heated to the target fixing temperature, namely, whether the normal operation mode has been restored, based on the result of measurement by the temperature measuring unit 6 (step A11).

If the normal operation mode has been restored (YES route of step A11), a toner image is formed on the printing paper 20 and then the toner of the image is fixed on the paper 20 (step A16). If the normal operation mode has not yet been restored (NO route of step A11), the procedure returns to step A10.

Figure 9:
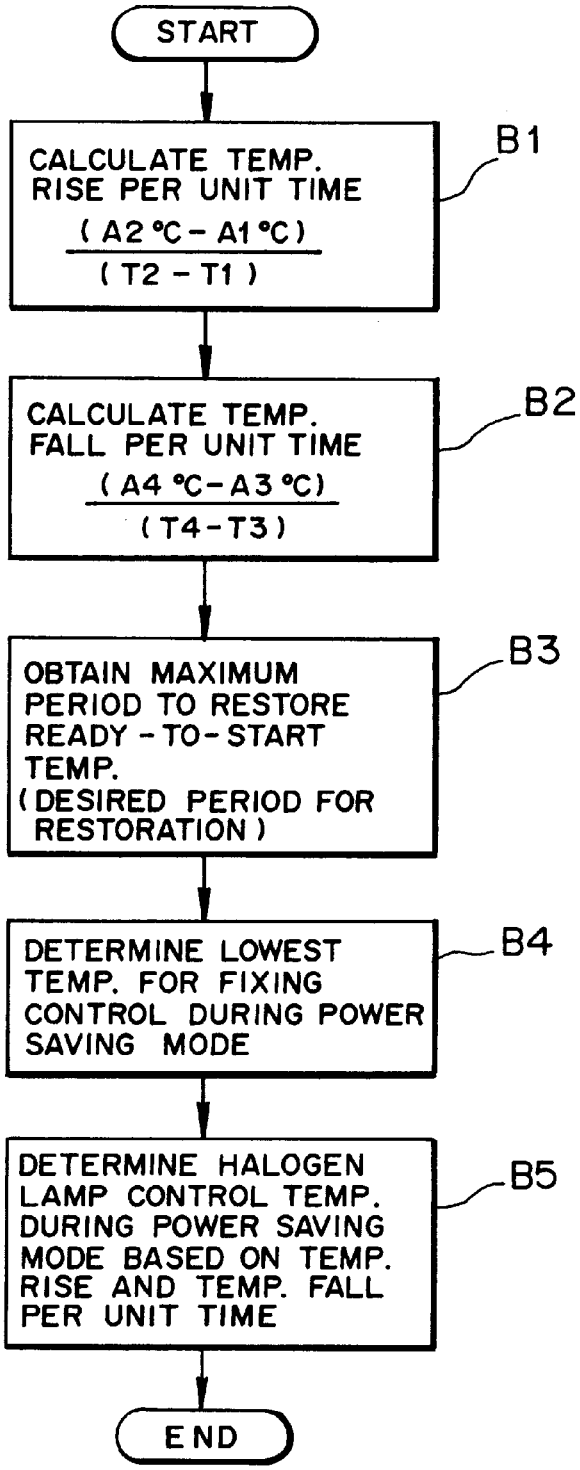
FIG. 9 is a flowchart illustrating a way of calculating the lowest temperature of a heat roller of the fixing device, in the image forming machine of the present embodiment, during the power saving mode.

In the present image forming machine 100, the lowest temperature of the heat roller 13 during the power saving mode is calculated by the temperature varying tendency calculating unit 9, when X minutes (a predetermined time) lapses without performing a image forming operation during the normal operation mode or when a predetermined time (e.g., two hours) lapses after the machine shifts to the power saving mode. How to calculate the lowest temperature of the heat roller 13 of the fixing device 4 of the image forming machine 100 of the present embodiment during the power saving mode will now be described with reference to the flowchart (step B1 through step B5) of FIG. 9.

The temperature varying tendency calculating unit 9 calculates the tendency of temperature rise in terms of the amount of temperature rise per unit time (A2−A1)/(T2−T1) when the temperature of the heat roller 13 is controlled so as to rise (step B1) taking temperature A1 of the heat roller 13 at time T1 and temperature A2 at time T2, based on the tendency of temperature rise of the heat roller 13.

Next, the temperature varying tendency calculating unit 9 calculates the tendency of temperature fall in terms of the amount of temperature fall per unit time (A4−A3)/(T4−T3) when the temperature of the heat roller 13 is controlled so as to fall (step B2), taking temperature A3 of the heat roller 13 at time T3 and temperature A4 at time T4, based on the tendency of temperature fall of the heat roller 13.

The temperature calculating unit 10 obtains the desired restoration period input from the operation panel 7. Otherwise if the desired period has not been input by the operator, the temperature calculating unit 10 obtains a preset standard period to be regarded as the desired restoration period (step B3).

Then the temperature calculating unit 10 calculates, the lowest temperature of the heating roller 13 during the power saving mode in terms of the temperature such that the duration till the temperature of the heating roller 13 reaches the target fixing temperature is the desired restoration period based on the tendency of temperature rise calculated by the temperature varying tendency calculating unit 9 (step B4).

Precisely, the temperature calculating unit 10 calculates the amount of temperature rise, which will be generated based on the measured tendency of temperature rise during the desired restoration period, and then subtracts the calculated temperature rise amount from the target fixing temperature, thus obtaining the lowest temperature of the heat roller 13.

The fixing temperature control unit 8 controls the heat roller 13 based on the result of measurement by the temperature measuring unit 6 such that the temperature of the heat roller 13 is kept not less than the lowest temperature thus recalculated by the temperature calculating unit 10.

Namely, for turning the heater lamp 12 to decrease the temperature of the heat roller 13, the fixing temperature control unit 8 turns the heater lamp 12 on at a timing such that the temperature of the heat roller 13 is kept not less than the lowest temperature calculated by the temperature calculating unit 10, in view of the tendency of temperature fall calculated at step B1 and step B2 (step B5).

At that time, the fixing temperature control unit 8 turns the heater lamp 12 on/off by a longer cycle of turning on than the cycle during the normal operation mode, the latter cycle being calculated by the cycle calculating unit 5.

Figure 10:
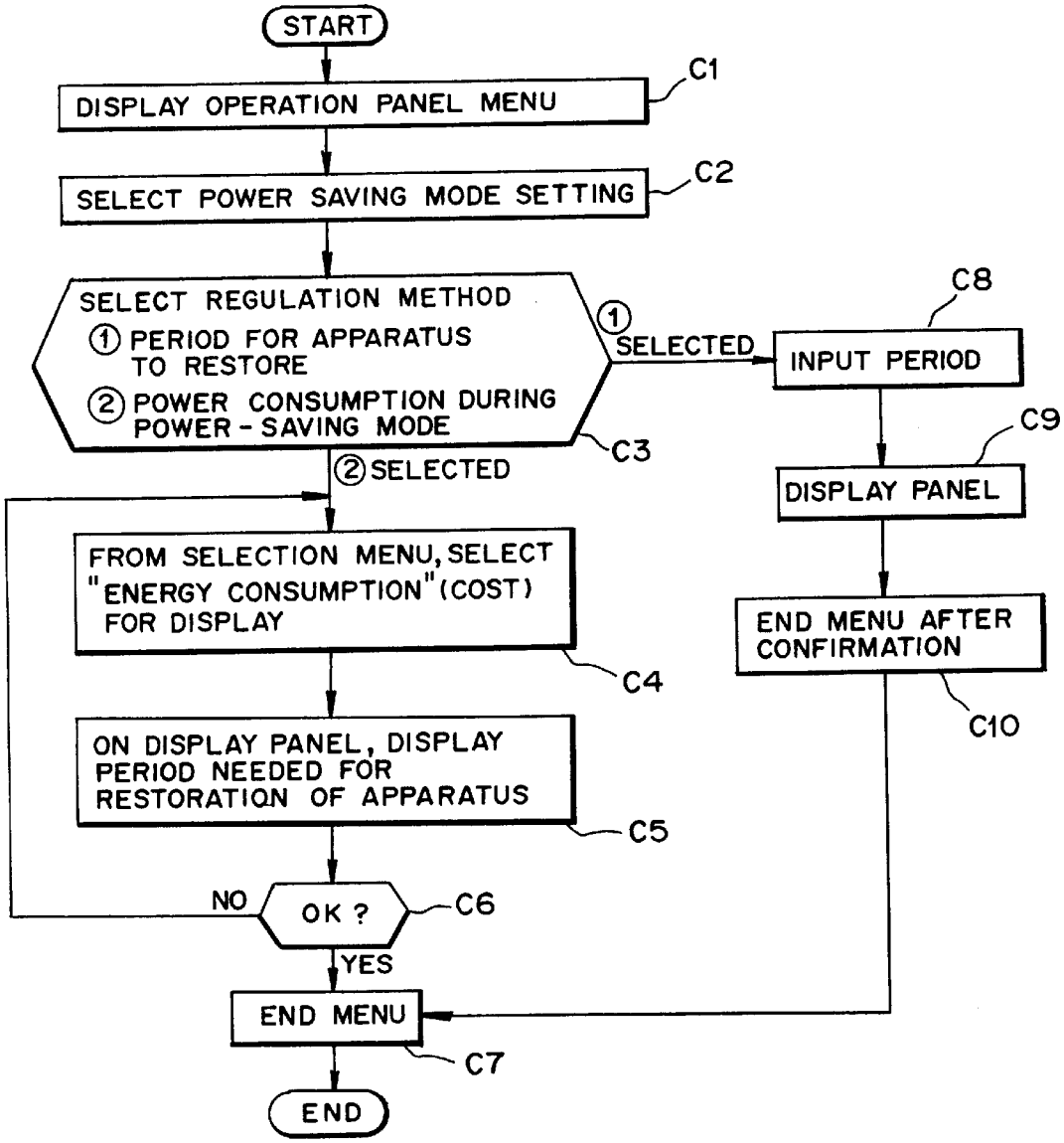
FIG. 10 is a flowchart illustrating a way of setting the power saving mode in the image forming machine of the present embodiment.

How to set the power saving mode in the image forming machine 100 of the present embodiment will now be described with reference to the flowchart (step Cl through C10) of FIG. 10.

For setting the power saving mode, the operator firstly makes input operations from the operation panel 70 (shown in FIG. 6 and FIG. 7) to display on the display panel 71 a menu (operation panel menu) for mode selection (step C1), and then selects the power saving mode to be set (step C2).

The operator then selects one of the following two ways of regulating operations during the power saving mode (step C3): ① to determine the period for restoring the normal operation mode from the power saving mode, and ② to determine the power consumption during the power saving mode.

Here, if the period for restoring the normal operation mode is selected ("① SELECTED" route of step C3), a massage saying "Set the restoration period." is displayed on the display panel 71 as shown in FIG. 7.

After the operator inputs an arbitrary restoration period via the input unit 72 (step C8) the input restoration period is displayed on the display panel 71 along with a description "period to restore after power saving mode:" (step C9). In FIG. 7, the operator inputs 20 (seconds) as the desired restoration period.

After confirming the restoration period displayed on the display panel 71, the operator terminates inputting the restoration period (step C10) by depressing a confirmation button or the like, and also terminates setting the power saving mode on a main menu (step C7).

On the other hand, if the power consumption during the power saving mode is to be selected as a reference for operation ("② SELECTED" route of step C3), several preset amounts of power (energy) consumption are displayed on the display panel 71 so that the operator can select one as a desired amount of power consumption (step C4).

The period needed for the machine 100 to restore the normal operation mode from the power saving mode is calculated based on the selected amount of power consumption and the tendency of temperature rise calculated by the temperature varying tendency calculating unit 9, and is then displayed on the display panel 71 (step C5).

Looking at the restoration period displayed on the display panel 71, if the operator finds the displayed period too long or too short, or if the operator inputs, via the input unit 72, that the displayed period is unsatisfactorily shorter than the operator can wait (NO route of step C6), the procedure returns to step C4.

Otherwise if the operator finds the displayed period reasonable and inputs, via the input unit 72, that the displayed period is satisfactory (YES route of step C6), the machine 100 terminates setting of the power saving mode on the main menu (step C7).

Figure 11:
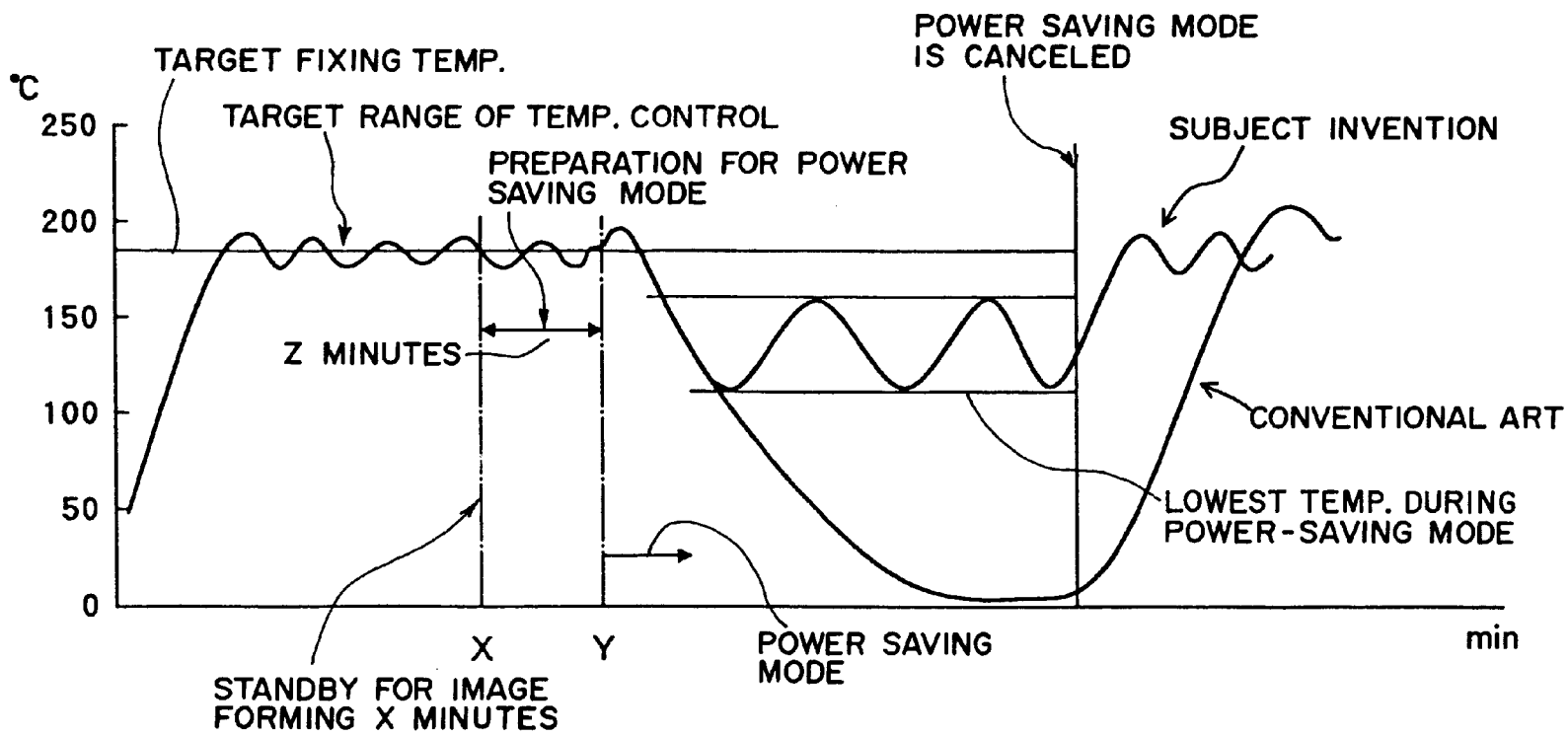
FIG. 11 is a graph showing how the temperature of the fixing device is controlled in the image forming machine of the present embodiment.
Figure 12:
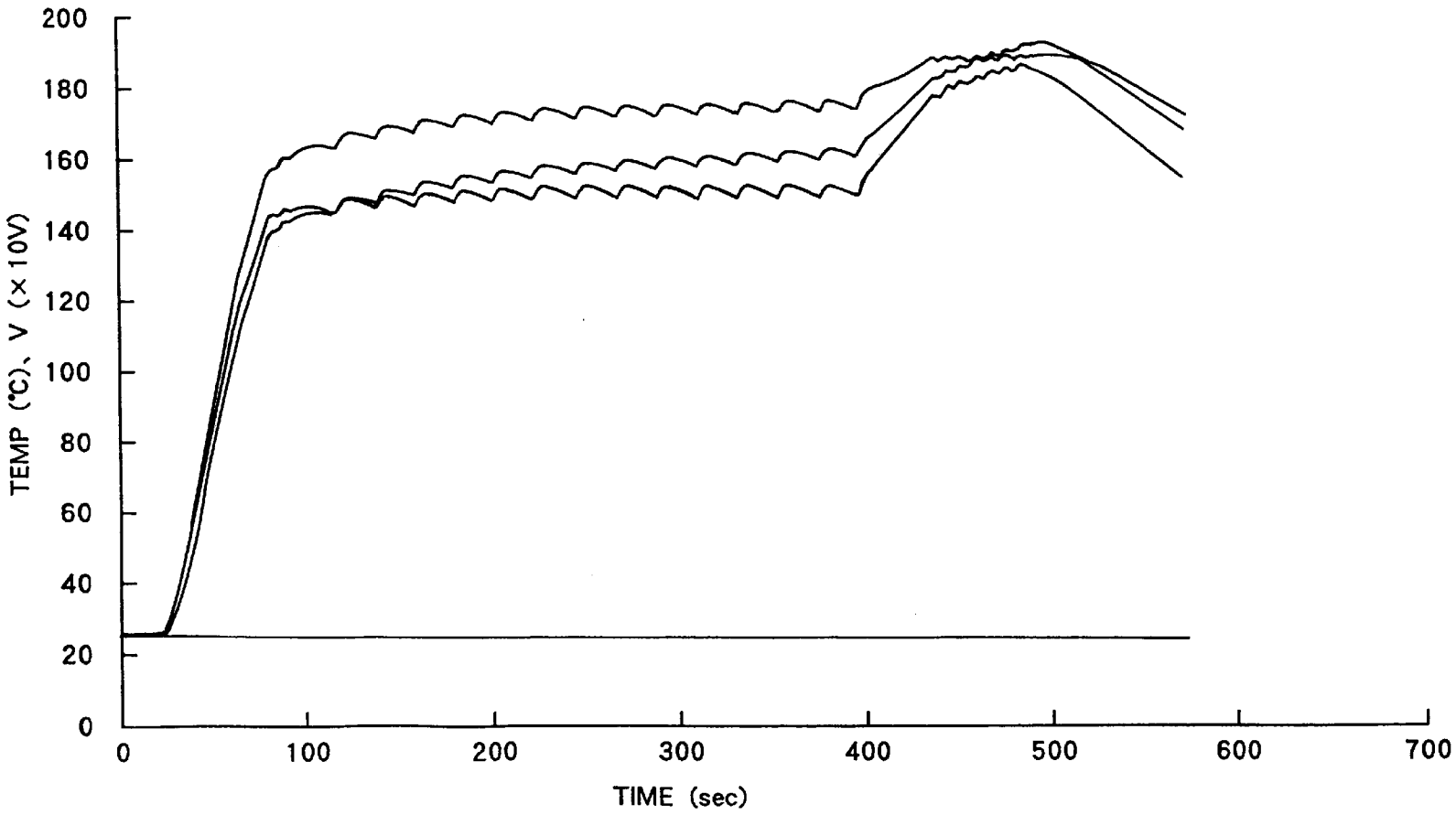
FIG. 12 RELATED ART
FIG. 12 is a graph showing a tendency of temperature rise on the circumferential surface of a heat roller in an image forming machine.

FIG. 11 is a graph illustrating the manner in which the temperature of the fixing device 4 of the image forming machine 100 in the present embodiment is controlled, in comparison with a fixing device of the conventional image forming machine. The fixing device of the conventional image forming machine of FIG. 11 turns the heater lamp off during the power saving mode.

FIG. 11 proves that in the present embodiment, the period is shorter during which the fixing unit 4 of the image forming machine 100 of the present invention reaches the target fixing temperature (approximately 185° C. in FIG. 11) after canceling the power saving mode, as compared to the conventional control.

In the image forming machine 100 of the present embodiment, during the normal operation mode, the temperature measuring unit 6 measures the temperature of the heat roller 13, and based on the result of this measurement, the temperature varying tendency calculating unit 9 calculates the tendency of temperature rise in terms of an amount of temperature rise per unit time when the temperature of the heat roller 13 is controlled so as to rise during the normal operation mode. Then based on the tendency of temperature rise, the temperature calculating unit 10 calculates the lowest temperature of the heat roller 13 during the power saving mode in terms of the temperature such that the duration till the temperature of the heat roller 13 reaches the target fixing temperature enough to melt the toner of the image is the desired period during which the fixing device restores the normal operation mode from the power saving mode. Finally, the fixing temperature control unit 8 keeps the temperature of the heat roller 13 not less than the lowest temperature. Having these features, the image forming machine 100 can restore the normal operation mode from the power saving mode within a desired restoration period with no risk of impairing the power saving function. Accordingly, the restoration period would never exceed a limit the user can be patient to wait, realizing comfortable operations with the machine.

As a preferred feature, the fixing temperature control unit 8 controls the temperature of the heat roller 13 by intermittently turning on/off the built-in heater lamp 12. With this preferred feature, it is possible to control the temperature of the heating unit with accuracy, thus improving the reliability of the image forming machine 100.

As another preferred feature, during the normal operation mode, the cycle calculating unit 5 calculates, based on the intervals of turning on/off of the heater lamp 12, the cycle of turning on of the heater lamp 12 during the normal operation mode. And during the power saving mode, the heater lamp is intermittently turned on/off by a longer cycle than the calculated cycle of turning on based on the same calculated intervals. With this feature, it is possible to reduce the frequency of turning on/off of the heater lamp during the power saving mode, thus extending the life of the heater lamp and reducing the power consumption that might have been caused due to a sudden rise of electric current upon turning on of the heater lamp.

As still another preferred feature, the temperature calculating unit 10 calculates the lowest temperature of the heat roller 13 a predetermined time (Z minutes) earlier than when the fixing device 4 shifts to the power saving mode. With this feature, it is possible to keep the influence of environment of installation of the machine to a minimum. Even if the installation environment varies, the machine 100 can restore within a desired period the normal operation mode from the power saving mode. Consequently the restoration period would never exceed a limit the user can be patient to wait, realizing comfortable operations with the machine.

As a further preferred feature, the cycle calculating unit 5 calculates the lowest temperature of the heat roller 13 a predetermined time (Z minutes) earlier than when the machine 100 shifts to the power saving mode. With this feature, it is possible to keep the influence of environment of installation of the machine to a minimum and also to surely reduce the frequency of turning on/off of the heater lamp 12 during the power saving mode to the level less than that during the normal operation mode, thus extending the life of the heater lamp 12 and reducing the power consumption that might have been caused due to a sudden rise of electric current upon turning on of the heater lamp 12.

As an additional preferred feature, during the power saving mode, the temperature varying tendency calculating unit 9 calculates the tendency of temperature rise in terms of an amount of temperature rise per unit time when the temperature of the heat roller 13 is controlled so as to rise, based on the result of temperature measurement. Then based on the calculated tendency of temperature rise, the temperature calculating unit 10 recalculates the lowest temperature. Then the fixing temperature control unit 8 keeps the temperature of the heat roller 13 not less than this recalculated lowest temperature. With this feature, it is possible to calculate the tendency of temperature rise and the lowest temperature with accuracy, thus improving the reliability of the image forming machine 100.

As another preferred feature, the image forming machine 100 of the present invention further includes the operation panel 7 (the input unit 72) from which an arbitrary period is set/input as the desired period during which the image forming machine restores the normal operation mode from the power saving mode. With this preferred feature, the operator can set or input a desired restoration period, guaranteeing comfortable operations with the machine.

As still another preferred feature, the image forming machine 100 of the present invention has a preset standard period as the desired restoration period. Thus, even in the absence of the desired restoration period input from the operation panel 7, the temperature calculating unit 10 can use such preset value to calculate the lowest temperature of the heat roller 13.

In the present embodiment, the photosensitive drum 1 is utilized as the image supporting unit. As an alternative image supporting unit, a endless belt may be used.

The present invention should by no means be limited to the illustrated embodiment, and various other changes or modifications may be suggested without departing the gist of the inventive concept.

What is claimed is:

1. A method of controlling temperature of a heating unit of a fixing device, which shifts from a normal operation mode to a power saving mode after the lapse of a predetermined time without performing a fixing operation during the normal operation mode and restores the normal operation mode upon receipt of a fixing operation request during the power saving mode, to fix a toner image, which is formed on a medium, to the medium as the heating unit heats the toner of the image, said method comprises the steps of:

(a) measuring a temperature of the heating unit during the normal operation mode;

(b) calculating a first tendency of temperature rise in terms of an amount of temperature rise per unit time when the temperature is controlled so as to rise during the normal operation mode, based on the result of temperature measurement;

(c) calculating, based on said first tendency of temperature rise, a lowest temperature of the heating unit during the power saving mode in terms of a temperature such that a duration till the temperature of the heating unit reaches a target fixing temperature enough to melt the toner of the image is a desired period during which the fixing device restores the normal operation mode from the power saving mode; and (d) keeping the temperature of the heating unit not lower than said lowest temperature.

2. A method according to claim 1, where the temperature of the heating unit is controlled by intermittently turning a heater lamp in a heat roller, which constitutes the heating unit, on/off.

3. A method according to claim 2, further comprising the step of calculating a cycle of turning on of the heater lamp during the normal operation mode, wherein during the power saving mode the heater lamp is intermittently turned on/off by a longer cycle than the calculated cycle of turning on.

4. A method according to claim 1, wherein said lowest temperature of the heating unit is calculated a predetermined time earlier than when the fixing device shifts to the power saving mode.

5. A method according to claim 3, wherein said lowest temperature of the heating unit is calculated a predetermined time earlier than when the fixing device shifts to the power saving mode.

6. A method according to claim 3, wherein said cycle of turning on of the heater lamp is calculated a predetermined time earlier than when the fixing device shifts to the power saving mode.

7. A method according to claim 1, further comprising the steps of:

during the power saving mode calculating a second tendency of temperature rise in terms of an amount of temperature rise per unit time when the temperature of the heating unit is controlled so as to rise, based on the result of temperature measurement;

recalculating said lowest temperature based on said second tendency of temperature rise; and keeping the temperature of the heating unit not lower than said recalculated lowest temperature.

8. A method according to claim 5, further comprising the steps of:

during the power saving mode calculating a second tendency of temperature rise in terms of an amount of temperature rise per unit time when the temperature of the heating unit is controlled so as to rise, based on the result of temperature measurement;

recalculating said lowest temperature based on said second tendency of temperature rise; and keeping the temperature of the heating unit not lower than said recalculated lowest temperature.

9. A method according to claim 6, further comprising the steps of:

during the power saving mode calculating a second tendency of temperature rise in terms of an amount of temperature rise per unit time when the temperature of the heating unit is controlled so as to rise, based on the result of temperature measurement;

recalculating said lowest temperature based on said second tendency of temperature rise; and keeping the temperature of the heating unit not lower than said recalculated lowest temperature.

10. An apparatus for controlling temperature of a heating unit of a fixing device, which shifts from a normal operation mode to a power saving mode after the lapse of a predetermined time without performing a fixing operation during the normal operation mode and restores the normal operation mode upon receipt of a fixing operation request during the power saving mode, to fix a toner image, which is formed on a medium, to the medium as the heating unit heats the toner of the image, said apparatus comprises:

a temperature measuring unit for measuring a temperature of the heating unit of the fixing device;

a fixing temperature control unit for keeping the temperature of the heating unit, during the normal operation mode, at a target fixing temperature enough to melt the toner of the image and, during the power saving mode, lower than said target fixing temperature;

a temperature rise tendency calculating unit for calculating a first tendency of temperature rise in terms of an amount of temperature rise per unit time when the temperature of the heating unit is controlled so as to rise during the normal operation mode, based on the result of temperature measurement;

a temperature calculating unit for calculating a lowest temperature of the heating unit during the power saving mode in terms of a temperature such that a duration till the temperature of the heating unit reaches said target fixing temperature is a desired period during which the fixing device restores the normal operation mode from the power saving mode; and said fixing temperature control unit being operable to keep the temperature of the heating unit not lower than said lowest temperature during the power saving mode, based on the result of temperature measurement of said temperature measuring unit.

11. An apparatus according to claim 10, wherein said fixing temperature control unit controls the temperature of the heating unit by intermittently turning a heater lamp in a heat roller, which constitutes the heating unit, on/off.

12. An apparatus according to claim 11, further comprising a cycle calculating unit for calculating a cycle of turning on of the heater lamp during the normal operation mode, said fixing temperature control unit being operable to turn the heater lamp on at a longer cycle than said cycle of turning on during the power saving mode.

13. An apparatus according to claim 10, wherein said temperature calculating unit calculates said lowest temperature of the heating unit a predetermined time earlier than when the fixing device shifts to the power saving mode.

14. An apparatus according to claim 12, wherein temperature calculating unit calculates said lowest temperature of the heating unit a predetermined time earlier than when the fixing device shifts to the power saving mode.

15. An apparatus according to claim 12, wherein said cycle calculating unit calculates said cycle of turning on of the heater lamp a predetermined time earlier than when the fixing device shifts to the power saving mode.

16. An apparatus according to claim 10, wherein during the power saving mode said temperature rise tendency calculating unit calculates a second tendency of temperature rise in terms of an amount of temperature rise per unit time when the temperature of the heating unit is controlled so as to rise, based on the result of temperature measurement, said temperature calculating unit recalculates said lowest temperature based on said second tendency of temperature rise, and said fixing temperature control unit keeps the temperature of the heating unit not lower than said recalculated lowest temperature based on the result of temperature measurement.

17. An apparatus according to claim 14, wherein during the power saving mode said temperature rise tendency calculating unit calculates a second tendency of temperature rise in terms of an amount of temperature rise per unit time when the temperature of the heating unit is controlled so as to rise, based on the result of temperature measurement, said temperature calculating unit recalculates said lowest temperature based on said second tendency of temperature rise, and said fixing temperature control unit keeps the temperature of the heating unit not lower than said recalculated lowest temperature based on the result of temperature measurement.

18. An apparatus according to claim 15, wherein during the power saving mode said temperature rise tendency calculating unit calculates a second tendency of temperature rise in terms of an amount of temperature rise per unit time when the temperature of the heating unit is controlled so as to rise, based on the result of temperature measurement, said temperature calculating unit recalculates said lowest temperature based on said second tendency of temperature rise, and said fixing temperature control unit keeps the temperature of the heating unit not lower than said recalculated lowest temperature based on the result of temperature measurement.

19. A fixing device, which shifts from a normal fixing mode to a power saving mode after the lapse of a predetermined time without performing a fixing operation during the normal fixing mode and restores the normal operation mode upon receipt of a fixing operation request during the power saving mode, for fixing a toner image formed on a medium, said device comprising:

a heating unit for heating the toner of the image into a molten form to cause the molten form to adhere to the medium;

a temperature measuring unit for measuring a temperature of said heating unit;

a fixing temperature control unit for keeping the temperature of said heating unit, during the normal operation mode, at a target fixing temperature and, during the power saving mode, lower than said target fixing temperature;

a temperature rise tendency calculating unit for calculating a first tendency of temperature rise in terms of an amount of temperature rise per unit time when the temperature of said heating unit is controlled so as to rise during the normal operation mode, based on the result of temperature measurement;

a temperature calculating unit for calculating a lowest temperature of said heating unit during the power saving mode in terms of a temperature such that a duration till the temperature of said heating unit reaches said target fixing temperature is a desired period during which said fixing device restores the normal operation mode from the power saving mode; and said fixing temperature control unit being operable to keep the temperature of said heating unit not lower than said lowest temperature during the power saving mode, based on the result of temperature measurement of said temperature measuring unit.

20. A fixing device according to claim 19, wherein said heating unit includes a heat roller having a built-in heater lamp that is to be turned on/off by said fixing temperature control unit for keeping the temperature of said heating unit.

21. A fixing device according to claim 20, further comprising a cycle calculating unit for calculating a cycle of turning on of said heater lamp during the normal operation mode, said fixing temperature control unit being operable to turn said heater lamp on at a longer cycle than said cycle of turning on during the power saving mode.

22. A fixing device according to claim 19, wherein said temperature calculating unit calculates said lowest temperature of said heating unit a predetermined time earlier than when said fixing device shifts to the power saving mode.

23. A fixing device according to claim 21, wherein temperature calculating unit calculates said lowest temperature of said heating unit a predetermined time earlier than when said fixing device shifts to the power saving mode.

24. A fixing device according to claim 21, wherein said cycle calculating unit calculates said cycle of turning on of said heater lamp a predetermined time earlier than when said fixing device shifts to the power saving mode.

25. A fixing device according to claim 19, wherein during the power saving mode said temperature rise tendency calculating unit calculates a second tendency of temperature rise in terms of an amount of temperature rise per unit time when the temperature of said heating unit is controlled so as to rise, based on the result of temperature measurement, said temperature calculating unit recalculates said lowest temperature based on said second tendency of temperature rise, and said fixing temperature control unit keeps the temperature of the heating unit not lower than said recalculated lowest temperature based on the result of temperature measurement.

26. A fixing device according to claim 23, wherein during the power saving mode said temperature rise tendency calculating unit calculates a second tendency of temperature rise in terms of an amount of temperature rise per unit time when the temperature of said heating unit is controlled so as to rise, based on the result of temperature measurement, said temperature calculating unit recalculates said lowest temperature based on said second tendency of temperature rise, and said fixing temperature control unit keeps the temperature of said heating unit not lower than said recalculated lowest temperature based on the result of temperature measurement.

27. A fixing device according to claim 24, wherein during the power saving mode said temperature rise tendency calculating unit calculates a second tendency of temperature rise in terms of an amount of temperature rise per unit time when the temperature of said heating unit is controlled so as to rise, based on the result of temperature measurement, said temperature calculating unit recalculates said lowest temperature based on said second tendency of temperature rise, and said fixing temperature control unit keeps the temperature of said heating unit not lower than said recalculated lowest temperature based on the result of temperature measurement.

28. An image forming machine, which is controlled so as to shift from a normal operating mode to a power saving mode after the lapse of a predetermined time without performing an image forming operation during the normal operation mode and to restore the normal operation mode upon receipt of an image forming operation request during the power saving mode, said apparatus comprising:

an image supporting unit on which a latent image is to be formed based on given image information;

a developing unit for bringing the latent image to a visible image using toner;

a transferring unit for transferring the developed image on said image supporting unit to a medium;

a fixing device having a heating unit for heating the toner of the image, which is transferred to the medium, to fix the toner image to the medium;

a temperature measuring unit for measuring a temperature of said heating unit of said fixing device;

a fixing temperature control unit for keeping the temperature of said heater unit, during the normal operation mode, at a target fixing temperature enough to melt the toner of the image and, during the power saving mode, lower than said target fixing temperature;

a temperature rise tendency calculating unit for calculating a first tendency of temperature rise in terms of an amount of temperature rise per unit time when the temperature of said heating unit is controlled so as to rise during the normal operation mode, based on the result of temperature measurement;

a temperature calculating unit for calculating a lowest temperature of said heating unit during the power saving mode in terms of a temperature such that a duration till the temperature of said heating unit reaches said target fixing temperature is a desired period during which said image forming machine restores the normal operation mode from the power saving mode; and said fixing temperature control unit being operable to keep the temperature of said heating unit not lower than said lowest temperature during the power saving mode, based on the result of temperature measurement of said temperature measuring unit.

29. An image forming machine according to claim 28, wherein said heating unit includes a heat roller having a built-in heater lamp, said fixing temperature control unit being operable to control the temperature of said heating unit by intermittently turning said heater lamp on/off.

30. An image forming machine according to claim 29, further comprising a cycle calculating unit for calculating a cycle of turning on of said heater lamp during the normal operation mode, said fixing temperature control unit being operable to turn said heater lamp on at a longer cycle than said cycle of turning on during the power saving mode.

31. An image forming machine according to claim 28, wherein said temperature calculating unit calculates said lowest temperature of said heating unit a predetermined time earlier than when said fixing device shifts to the power saving mode.

32. An image forming machine according to claim 30, wherein said cycle calculating unit calculates said cycle of turning on of said heater lamp a predetermined time earlier than when said fixing device shifts to the power saving mode.

33. An image forming machine according to claim 28, wherein during the power saving mode said temperature rise tendency calculating unit calculates a second tendency of temperature rise in terms of an amount of temperature rise per unit time when the temperature of said heating unit is controlled so as to rise, based on the result of temperature measurement, said temperature calculating unit recalculates said lowest temperature based on said second tendency of temperature rise, and said fixing temperature control unit keeps the temperature of said heating unit not lower than said recalculated lowest temperature based on the result of temperature measurement.

34. An image forming machine according to claim 32, wherein during the power saving mode said temperature rise tendency calculating unit calculates a second tendency of temperature rise in terms of an amount of temperature rise per unit time when the temperature of said heating unit is controlled so as to rise, based on the result of temperature measurement, said temperature calculating unit recalculates said lowest temperature based on said second tendency of temperature rise, and said fixing temperature control unit keeps the temperature of said heating unit not lower than said recalculated lowest temperature based on the result of temperature measurement.

35. An image forming machine according to claim 28, further comprising a time input unit for setting/inputting an arbitrary time as said desired time during which said image forming machine restores the normal operation mode from the power saving mode.

36. An image forming machine according to claim 34, further comprising a time input unit for setting/inputting an arbitrary time as said desired time during which said image forming machine restores the normal operation mode from the power saving mode.

* * * * *